United States Patent [19]

Belbel et al.

[11] Patent Number: 4,751,483

[45] Date of Patent: Jun. 14, 1988

[54] ELECTRIC SWITCH FOR PROTECTION APPLIANCES SUCH AS A CUT OUT

[75] Inventors: Elie Belbel, Epinay sur Seine; Félix Lameyre, Rueil Malmaison; Michel Lauraire, Courbevoie, all of France

[73] Assignee: La Telemecanique Electrique, France

[21] Appl. No.: 30,315

[22] Filed: Mar. 26, 1987

[30] Foreign Application Priority Data

Apr. 4, 1986 [FR] France ..... 86 04840

[51] Int. Cl.[4] ..... H01H 75/00; H01H 77/00; H01H 83/00

[52] U.S. Cl. ..... 335/14; 335/20; 200/151

[58] Field of Search ..... 335/6, 16, 14, 20; 200/151, 144 R

[56] References Cited

U.S. PATENT DOCUMENTS

| | | | |
|---|---|---|---|
| 4,536,630 | 8/1985 | Belbel et al. | 200/151 |
| 4,598,263 | 7/1986 | Heyne et al. | 335/20 |
| 4,647,741 | 3/1987 | Belbel et al. | 200/151 |
| 4,659,888 | 4/1987 | Belbel et al. | 200/151 |

*Primary Examiner*—E. A. Goldberg
*Assistant Examiner*—Lincoln Donovan
*Attorney, Agent, or Firm*—William A. Drucker

[57] ABSTRACT

An electric switch protective apparatus is provided having a mobile contact which may be separated from a pseudo-fixed contact to which it is applied, either through the movement of coupling means of the mobile contact, or through the lateral movement made by a support of this pseudo-fixed contact under the action of connection means associated with a remote controlled electromagnet.

9 Claims, 4 Drawing Sheets

ELECTRIC SWITCH FOR PROTECTION APPLIANCES SUCH AS A CUT OUT

BACKGROUND OF THE INVENTION

1. Field of the Invention

The invention relates to an electric switching apparatus in an isolating case, in particular for a cut out appliance, in which each of the two conducting pieces of the switch which are intended to be applied one against the other or to be separated, may be moved independently of each other, depending on whether the opening manoeuver is operated by means of a remote controlled electromagnet placed in the case, or whether the opening operation results from a manual control or automatic operation of a mechanism tripped by monitoring means adapted for detecting excess current in the circuit of the switch.

The field of application of such apparatus extends to specific protective appliances up to cut out appliances used in industrial distribution systems of different ratings where it is desirable to be able to effect opening of the circuit in accordance with one of the two above mentioned modes.

2. Description of the Prior Art

Such apparatus are for example known from the European patent application No. 103 022 which describes an industrial type appliance in which a mobile switch contact may be opened by a manual control or by triggering a set mechanism; the mobile armature of an electromagnet is here associated indirectly with an intermediate tripping mechanism so as to cause remote controlled opening, independently of the other possible methods of opening the circuit.

A cut out appliance is also known for example from the patent FR No. 2 563 939 to the applicant whose applications are to be found in the electric distribution field and in which a rotary isolating screen is inserted rapidly between two switch contacts which have just separated.

The present invention provides a switch apparatus whose construction corresponds to that mentioned above and in which measures will be taken for providing it with the advantageous properties obtained by the use of the screen adapted for rapidly destabilizing the electric arc appearing at the time of opening.

SUMMARY OF THE INVENTION

According to the invention, the desired result is attained because:

a pseudo-fixed contact which is carried by the periphery of a pivoting isolated sector, connected to an armature of the remote controlled electromagnet and on which the mobile contact controlled by the mechanism bears radially, effects, during energization of this electromagnet, a lateral displacement which brings it opposite the bottom of a concentric isolating wall placed in the vicinity of the periphery.

whereas a rotary isolating support moves substantially concentrically to the sector so as to rapidly insert an insulating screen which it carries between separated contacts, and for causing it to pass above said dividing wall.

BRIEF DESCRIPTION OF THE DRAWINGS

The invention, as well as several embodiments to which it may lend itself, will be better understood from reading the following description with reference to the accompanying Figures, in which.

DESCRIPTION OF THE PREFERRED EMBODIMENTS

Figure 1:
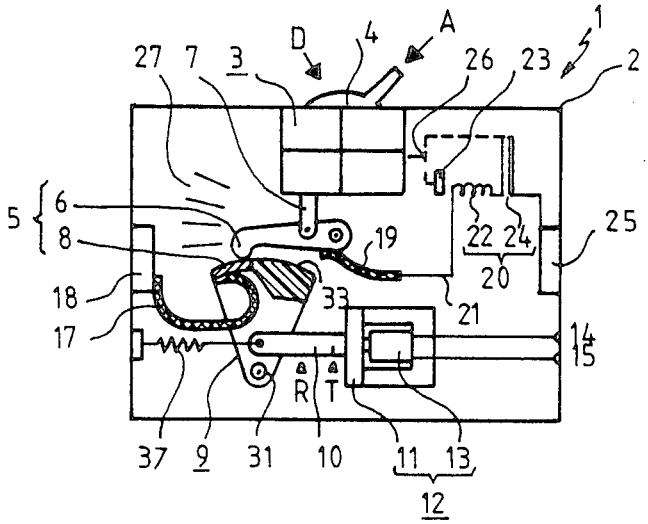
FIG. 1 shows schematically an apparatus according to the invention.

The apparatus 1, in which the invention is put into practice, is illustrated schematically in FIG. 1 to recall the presence of parts which will not be illustrated in detail in the following Figures, since some of which are known per se and which may have different relative arrangements depending on the applications envisaged.

In an insulating case 2 is placed an energy accumulating mechanism 3 generally using the compression of springs not shown; an external control member 4 can be used to give this mechanism a cocked A or uncocked D state for operating voluntarily the closure and respectively opening of the switch 5, to the mobile contact 6 of which it is mechanically connected by insulated transmission means 7.

The mobile contact cooperates with the pseudo-fixed contact 8 which is carried by a mobile insulated support 9 movable between a working position T and a rest position R. This possible movement follows from the presence of movement transmission means 10 which connect the support to the mobile armature 11 of an electromagnet 12 only the coil 13 of which has been shown; this latter is connected to connection terminals 14, 15 by which it may be energized and denergized.

A first flexible conductor 17 connects the pseudo-fixed contact 8 to an input terminal of the network 18 so as to allow the movements of the support, so that the electronic continuity is ensured when the support assumes the corresponding work position; when the electromagnet itself assumes its rest position R, for example through the action of a return spring 37, the two contacts are separated.

The mobile contact is in its turn connected by a second flexible conductor 19 to a portion 20 of the internal circuit 21 including one or more excess current detectors of different kinds, for example a coil 22 associated with a plunger core, magnetizable plate or striker 23 and a bimetallic strip 24. This latter is connected itself to output terminal 25 going towards the load not shown.

The bimetallic strip and/or the striker cause, through unlocking means 26, automatic tripping of the mechanism 3 which then assumes it uncocked state D. A cut off chamber 27 is associated with the switch so that arcs developed during opening of the switch are rapidly extinguished.

Figure 2:
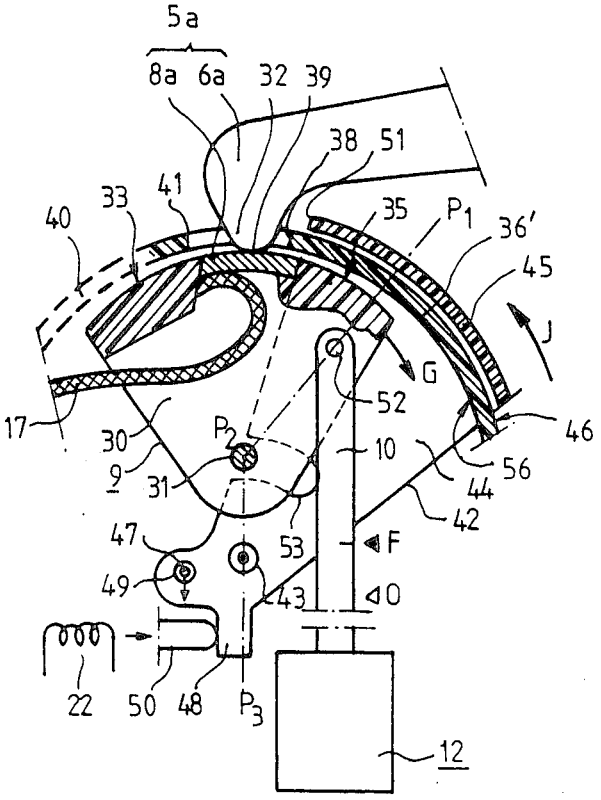
FIG. 2 shows in a local section passing through the plane of movement of the parts of the switch, the main elements of a first embodiment in which the pseudofixed contact support effects a tangential movement.

FIG. 2 shows a first embodiment 5a of the switch 5 in which the parts having functions identical with those which have just been described bear the same references.

The support 9 of the pseudo-fixed contact is shown here by an isolating sector 30 which may pivot about a pivot point 31 in the direction of arrow G, when the electromagnet is for example de-energized. This rotation therefore brings the insert 32 of the mobile contact 6A onto an insulated portion 33 of support 9, whereas the periphery of the sector carrying this pseudo-fixed contact moves under the internal surface 56 of a dividing wall 36.

The pseudo-fixed contact 8A here has the shape of a curved insert, whose radius corresponds to that of surface 33 and which is possibly extended by a concentric surface 35.

The fixed wall or dividing wall 36 of the case having a root 36' and a curved shape placed substantially concentrically with pivot 31 is extended as far as an end 38 close to the zone 39 in which the contact inserts meet; this dividing wall may also be extended similarly to a portion 40 shown with broken lines and an opening 41 then surrounds zone 39.

A rotary insulating part 42 adapted for pivoting about a pivot pin 43 adjacent pivot pin 31 or possible concentric therewith, includes an arm 44 in the shape of a sector and a cylinder portion forming a thin screen 45 which is placed above the dividing wall 36 opposite the external face 46 thereof opposite the pivot pin; the arm of this part 42 has on the opposite side 54 an actuating point such as 47 or a striking surface such as 48, which may receive, one a movement transmission piece 49 or the other the end or a strike 50.

Figure 8:
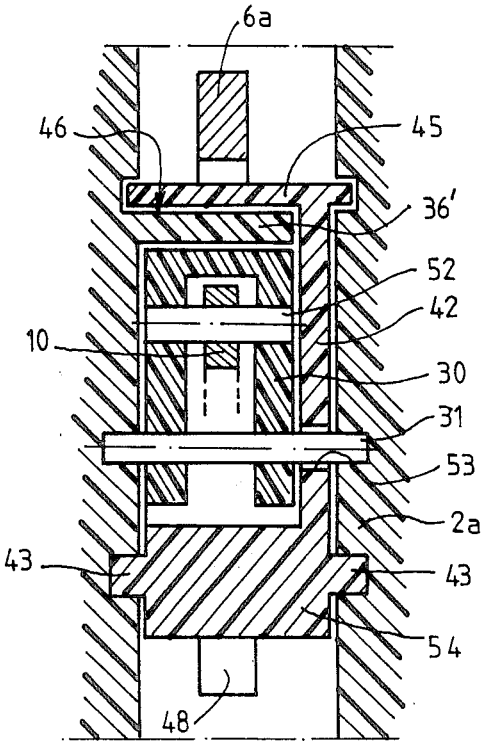
FIG. 8 illustrates in a side view the switch shown in FIG. 2 in section through a broken plane $P_1$, $P_2$, $P_3$.

This striker 50 of this transmission piece 49 may be formed by the striker which is shown at 23 in FIG. 1 or may transmit indirectly the movements of this latter. In both cases, the flow of a very intense current through the coil 22 causes movement thereof and driving of the screen in direction J; such a movement is only possible if the contact inserts are already separated by a sufficient gap to allow the rapid passage of the end 51 of the screen. A pivot point 52 connects the support 9 to a control link 10 and arm 42 here includes a recess 53 so that it does not meet pivot 31, see also FIG. 8.

It is known that the rapid reduction of the section or extension of an electric arc are accompanied by a rapid increase of its voltage, so that a very efficient limitation of the short circuit currents is obtained when an isolating screen causes destabilization of the arc.

Accompanying measures which are relative to the speed which this screen must have and to the means which cause efficient choking of the arc do not form the subject of the present application, but may of course be applied to the present switch device.

The means used for causing the movement of the pseudofixed contact, in particular the electromagnet may be deactivated so that movement of this pseudo-fixed contact in direction G is caused immediately after the appearance of a current fault, which thus confirms the automatic opening of the switch.

Such a measure will then require, if it is desired to reset the circuit, resetting of mechanism 3 and, furthermore, re-energization of the electromagnet it such has been interrupted.

In the embodiment which has just been described, the movements of the pseudo-fixed contact and of the screen follow opposite directions (G, and respectively J), when a current fault appears and separation of the contacts caused by support 30 takes place tangentially with rubbing, which may have an advantage for shearing the zones of these inserts which may possibly be welded.

Figure 3:
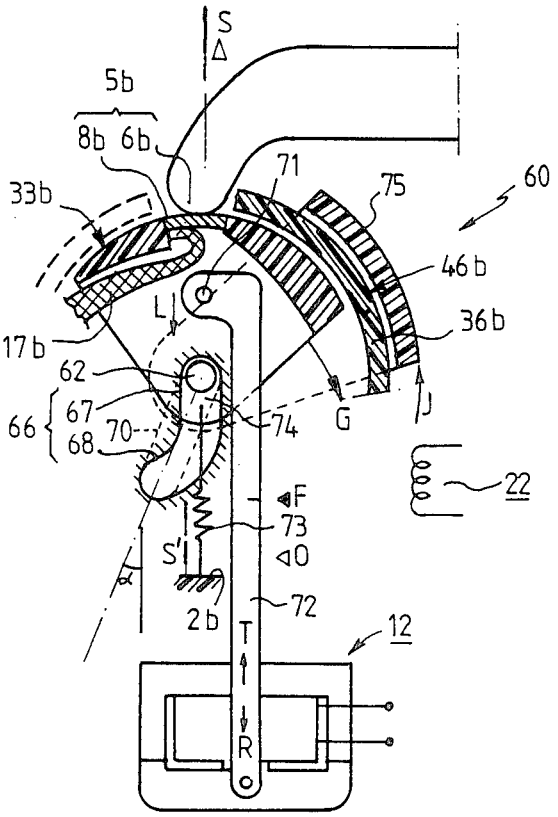
FIGS. 3, 4 and 5 illustrate in similar local sectional views variants of a second embodiment in which the pseudofixed contact supports effect composite movements.
Figure 4:
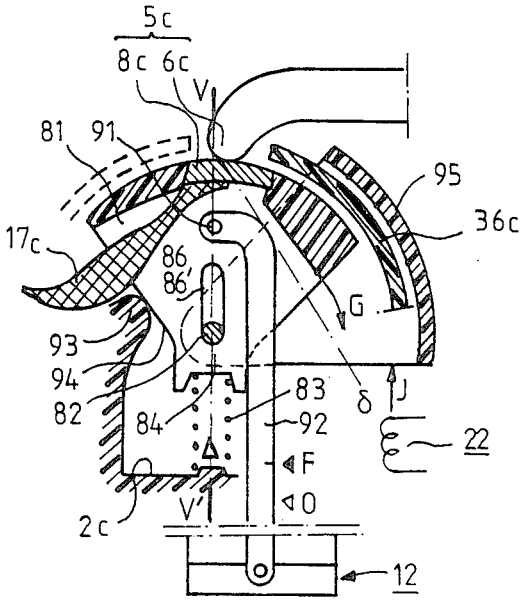
Figure 5:
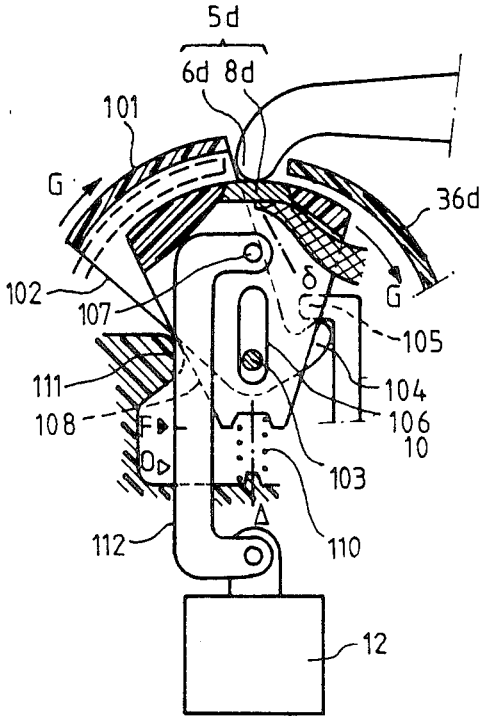

If preference is given to a radial separation of the contacts, which avoids frictional wear and possible metallization of the insulating portions such as 33, see FIG. 1, one of the two embodiments illustrated in FIGS. 3, 4 or 5 may be chosen.

Figure 6:
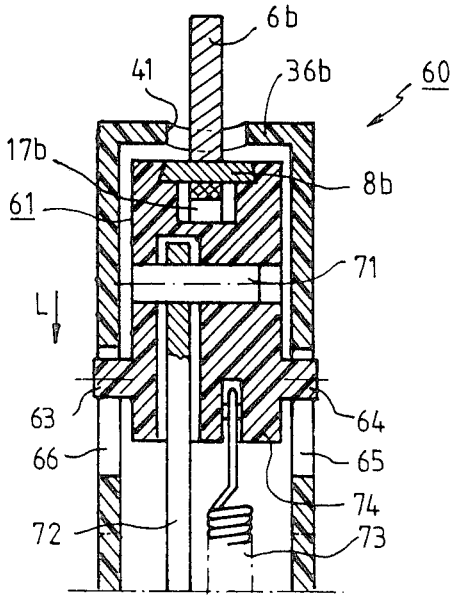
FIG. 6 shows a side view of the switch shown in FIG. 3 in section through a plane SS' which passes substantially through the straight line Δ.

In the varient 60 of switch 5*b* shown in FIG. 3, the movements of the insulating piece 61 supporting the pseudo-fixed contact 8*b* are guided by a pivot 62, movable parallel to itself, and including for example two coaxial swivels 63, 64 each capable of moving in one of two parallel and adjusted guide grooves 65, 66, see also FIG. 6.

Each groove such as 65 includes a first rectilinear portion 67 which is extended by a second curved portion 68; as a variant, a groove 70 shown with broken lines and slanted through an angle $\alpha$ with respect to a straight line $\Delta$ passing through one of the swivels 62 or pivot 71 and the contact zone, could also be used.

A pivot point 71 of support 61 which is placed between pivot pin 62 and the pseudo-fixed contact 8b receives an end of a coupling link 72 connected to an electromagnet armature not shown. This link which travels substantially parallel to the straight line $\Delta$ because of guide means not shown, is in the position F shown when the armature of the electromagnet is applied against its yoke, and conversely in position O. A traction spring such as 73 may be coupled to a point 74 and the support which is opposite the pivot point with respect to the pivot and to the case 2 so as to serve as return spring for the armature.

When the link moves downwards in direction L, after deenergization of the electromagnet, the contact support 61 moves first of all parallel to itself in the same direction when the swivel moves in portion 67, which causes radial separation of the contact inserts; this first parallel travel is followed by a second travel during which the swivel moves in portion 68 and imparts to this support a rotation of direction G. The movement therefore causes the contacts to benefit by a frictionless separation, followed by possible extension of the arc.

A screen 75 comparable to the preceding one 45 here moves in direction J in a way comparable to that described above while passing above a fixed insulating dividing wall 36*b*.

In the variant 80 shown in FIG. 4, the insulating support 81 for the pseudo-fixed contact 8*c* again has the shape of a sector with a central region 84 which is subjected to the action of a return spring under compression 83 placed between it and case 2*c*.

Figure 7:
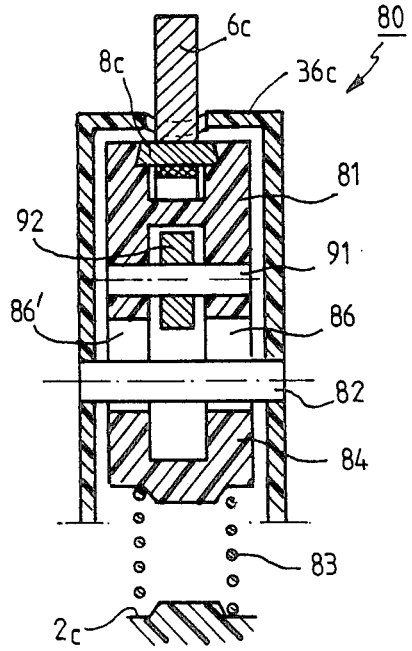
FIG. 7 shows a side view of the switch shown in figure 4 in section through a plane VV' which passes substantially through the straight line Δ.

This support further has one or two substantially radial grooves 86, 86' through which passes a transversely placed fixed guide pin 82 and a pivot point 91 connected to a link 92, see also FIG. 7.

In the position F shown of the link which corresponds to the working state T of the electromagnet, the pseudo-fixed contact 8*c*, the pivot point 91, groove 86 and pin 82 have the straight line $\Delta$ passing substantially therethrough, and a radial bearing face 94 of support 81 tangentially meets a fixed stop 93 of case 2*c*.

When the link is moved downwards in the Figure in the direction of point O by the return of the electromagnet to its rest state R, the cooperation between face 94 and stop 93 communicates to support 81 an initial movement of direction δ which is slanted with respect to the straight line Δ, and then an angular movement in direction G, which produces a result comparable to that obtained in the preceding example. Separation of the contacts is therefore again accomplished without friction.

We find again here a fixed insulating wall 36c and a movable screen 95 which moves in direction J during automtic opening of the contacts.

In the embodiment, shown in FIG. 5, which is derived from that of FIG. 4 a thin isolating screen 101 carried by a sector 102 is pivoted about a pin 103 and has a nose piece 104 adapted to receive a flange 105 connected directly or indirectly to a striker (not shown), which is attracted by a coil through which very intense currents flow when short circuit currents appear.

A support of the pseudo fixed contact **8*d* here again has a groove 106, a pivot point 107 connected to a link 112, a bearing face 108 meeting a fixed stop 111 and a central region 109 cooperating with a compression spring 110. In the state F of this link shown, in which the electromagnet is in the working position T, and in which flange 105 is not attracted in direction L towards the bottom of the Figure, screen 101 is placed in a half space placed to the left of straight line Δ, and will also move in direction G during attraction of the flange caused by that of the striker. Contrary to the preceding embodiments, this direction is here the same as that in which support 106 wil pivot when link 112** moves downwards of the Figure to pass from its position F to its position O.

As a variant groove 106 could be given a slightly slanted orientation with respect to the straight line Δ.

What is claimed is:

1. An electric switch comprising an insulating case having first and second contact pieces, said contact pieces separated through independently operating first means comprising a remote controlled electromagnet having a linearly movable armature and second means comprising a mechanism tripped by monitoring means which detect a current overload in the circuit of the switch:

said first contact piece is secured to the periphery of a pivotable isolated lever shaped as a sector of a circle and connected to said armature, and said second contact piece radially bears on said periphery when said second means has not been actuated and is separated from said periphery through substantially radial displacement with respect to said sector when said second means has been actuated;

an isolating fixed wall is located substantially concentric to said periphery and has an aperture through which said second contact piece is engaged when it bears on said periphery;

a pivotable isolating screen is movable substantially concentrically to said periphery and located farther from said periphery than said fixed wall;

said lever has a first position in which the first contact piece is located opposite the aperture and the second contact piece when the electromagnet is not actuated and, when the electromagnet is actuated, a second position in which the first contact piece is located opposite said fixed wall; and, when the second means has been actuated and the second contact piece has been separated from said sector, said screen is moved and inserted between said second contact piece and said lever.

2. The electric switch as claimed in claim 1, wherein said periphery has an isolating surface portion which is brought in said second position of said lever opposite the second contact piece through a tangential movement with respect to the second contact piece.

3. The electric switch as claimed in claim 1, wherein the displacement of said lever from the first position to the second position thereof comprises a first non tangential movement and a second angular pivoting movement.

4. The electric switch as claimed in claim 1, wherein the movement of the isolating screen an the movement of the lever from the first to the second position thereof are in opposite directions.

5. The electric switch as claimed in claim 1, wherein the isolating screen is further moved and inserted between the second contact piece and the lever when the lever is moved to the second position thereof and the movement of the lever from the first to the second position thereof and the movements of the screen occur in the same directions.

6. The electric switch as claimed in claim 3, wherein said displacement of the lever is effected in a plane through a relative cooperation of grooves and guide rods, fingers or pins perpendicular to said plane.

7. The electric switch as claimed in claim 6, wherein the grooves are rectilinear, the lever having a contact support surface which engages during the first movement a fixed stop of the case which initiates the angular pivoting movement.

8. The electric switch as claimed in claim 6, wherein said grooves have a first rectilinear portion and a second portion having a different direction.

9. The electric switch as claimed in claim 6, wherein said grooves have at least one portion which forms a predetermined angle with the direction of movement of said armature.

* * * * *